United States Patent [19]

Lundström

[11] Patent Number: 4,588,475

[45] Date of Patent: May 13, 1986

[54] METHOD AND DEVICE FOR REDUCING THE REWETTING OF WEB MATERIAL AFTER A PRESS NIP

[75] Inventor: Kristian Lundström, Soljala, Finland

[73] Assignee: Tamfelt Oy AB, Finland

[21] Appl. No.: 652,818

[22] Filed: Sep. 20, 1984

[30] Foreign Application Priority Data

Oct. 3, 1983 [FI] Finland ..... 833582

[51] Int. Cl.[4] ..... D21F 3/02

[52] U.S. Cl. ..... 162/205; 162/358; 100/153

[58] Field of Search ..... 162/205, 274, 275, 276, 162/358, 360.1; 100/118, 153

[56] References Cited

U.S. PATENT DOCUMENTS

| | | | |
|---|---|---|---|
| 3,290,209 | 12/1966 | Ihrman | 162/361 |
| 3,526,574 | 9/1970 | Beachler et al. | 162/205 |
| 3,797,384 | 3/1974 | Hoff | 162/360.1 |
| 4,199,401 | 4/1980 | Liu et al. | 162/358 |
| 4,483,745 | 11/1984 | Wicks et al. | 162/360.1 |

FOREIGN PATENT DOCUMENTS

| | | | |
|---|---|---|---|
| 16366 | 3/1933 | Finland . | |
| 686863 | 2/1953 | United Kingdom | 162/358 |

OTHER PUBLICATIONS

Finnish Application No. 822,245, 7/1982.

*Primary Examiner*—S. Leon Bashore
*Assistant Examiner*—K. M. Hastings
*Attorney, Agent, or Firm*—Scully, Scott, Murphy & Presser

[57] ABSTRACT

The invention relates to a method and a device for reducing the rewetting of a web after a press nip. The web to be dried is passed together with a press felt through a press nip formed by a first and a second press roll. The web and the felt are separated from each other after the press nip. For reducing the compressive pressure as quickly as possible after the center line of the nip, a mat made of a water-impermeable and resilient material is arranged to pass through the nip, said mat being in contact with the surface of either press roll and one of the surfaces of the web. After the press nip, the mat is subjected to a tensile stress, preferably by means of a second pair of rolls for preventing the returning of the mat to its original thickness starting immediately after the center line of the press nip.

6 Claims, 2 Drawing Figures

FIG. 1
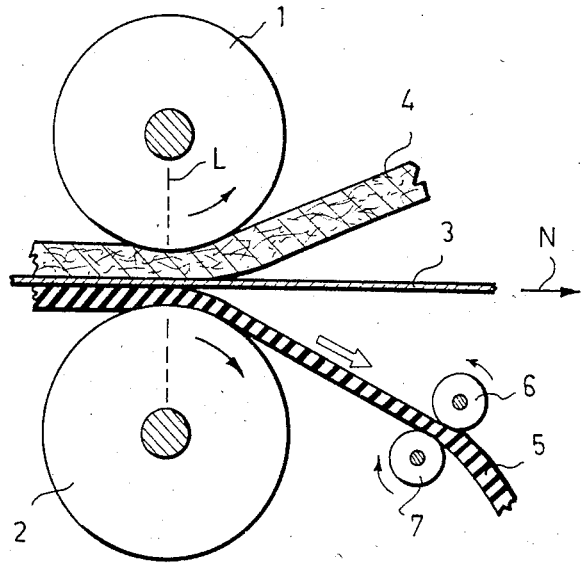
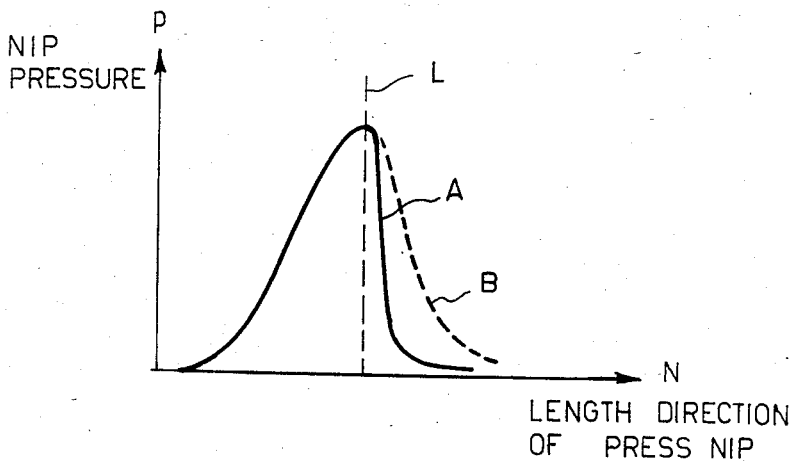
FIG. 2

METHOD AND DEVICE FOR REDUCING THE REWETTING OF WEB MATERIAL AFTER A PRESS NIP

The present invention relates to a method and a device for reducing the rewetting of a web after a press nip, wherein the web to be dried is passed together with a press felt through the press nip formed by a first and a second press roll and wherein said web and said felt are separated from each other after the nip.

The rewetting of a web is a phenomenon in which the water expressed from the web at the nip tends to reenter the web after the nip. The theory of rewetting has been discussed in several publications in the art. On the basis of published studies, emphasis has been given, for example, to the importance of felt design in preventing rewetting.

An example of felt design for preventing or reducing rewetting is the felt structure disclosed in U.S. Pat. No. 4,199,401. The manufacturing costs of such special felts are, however, relatively high, and therefore the aforesaid solution is not as a whole the best possible.

The object of the present invention is to provide a solution that is free from the disadvantages of the prior art, while efficiently reducing the occurrence of the rewetting phenomenon.

This has been achieved by means of the method of this invention, which is characterized in that after the press press nip the mat is subjected to a tensile stress for preventing the returning of the mat to its original thickness starting immediately after the center line L of the press nip and extending for a predetermined distance The device of this invention is characterized in that the mat is after the press nip arranged to pass between a second pair of press rolls, which pair of rolls is adjusted to rotate faster than the first and second press rolls and thus produces a tensile stress in the mat after the press nip formed by the first and second press rolls, thereby preventing the returning of the mat to its original thickness starting immediately after the center line of the press nip formed by the first and second press rolls and extending for a predetermined distance.

The advantage of the method and the device of this invention is their simplicity, which results in low manufacturing costs and reliable operation. Owing to the fact that no expensive special solutions are required for carrying out the method, it is relatively economical to work the invention.

The present invention will now be described in greater detail with reference to a schematic embodiment illustrated in the accompanying drawing, wherein FIG. 1 is a schematic side view of a press provided with a device according to the invention, and FIG. 2 is a schematic diagram of the pressure distribution in the nip of both a press provided with a device according to the invention and a conventional press.

FIG. 1 illustrates schematically a press comprising a first and a second press roll 1 and 2 located one above the other so that their axes are lying in the same vertical plane. The press rolls are also located so that there is a small gap between said rolls. A press nip, known in the art, is thus formed between the press rolls 1 and 2.

A suitable machinery (not shown) is used to rotate the rolls 1 and 2 in the direction indicated in the Figure. The press rolls may be rolls of a known type.

in FIG. 1 the web to be dried is designated by the reference numeral 3, and the press felt by the numeral 4.

The web 3 to be dried may be, for example, a paper web. The press felt 4 may be of any type known in the art.

In order to dry the web 3, it is passed together with the press felt 4 through the nip formed between the rotating press rolls 1 and 2 in the direction of arrow N. The water present in the web 3 is thus expressed from the web and transferred into one or more press felts 4. As the aforesaid pressing action is fully known in the art, it will not be described more closely herein.

In the end phase of the aforesaid pressing there occurs a problem related to rewetting; the water transferred into the press felt 4 tends, after the center line L of the nip, to re-enter the web 3 and thus impairs the properties thereof. Rewetting can be efficiently reduced if the press felt (s) can be separated from the web surface very quickly after the center line of the nip, In practice, however, this is difficult, because the felt thickness, which is reduced in the nip, increases after the center line L of the nip towards the original thickness, preventing a sufficiently quick separation from the web surface. The aforesaid phenomenon is clearly apparent from FIG. 2, in which the dashed line B indicates the change in compressive pressure after the center line L of the nip. The slow rate of pressure reduction results partly from the aforesaid change in felt thickness. The surfaces of the felt 4 and the web 3 are consequently in contact with one another, and rewetting may easily take place.

In order to prevent or reduce the aforesaid rewetting phenomenon, in the embodiment of FIG. 1, there is provided in accordance with the invention a mat 5 made of a water-impermeable and resilient material, which is passed through the nip formed by the press rolls 1 and 2. The mat 5 is arranged to pass through the nip in such a manner that one of its surfaces is in contact with one of the web surfaces, and the other surface is similarly in contact with the surface of either press roll. After the aforementioned nip the mat 5 is arranged to pass through a nip formed by a second pair of rolls 6, 7. The press rolls 6, 7 are rotated in the direction indicated by the arrows. The speed of rotation of the aforesaid pair of rolls 6, 7 is adjusted to be higher than that of the pair of rolls 1, 2 so that after the nip between the rolls 1, 2 a tensile stress is produced in the mat to prevent the mat 5 from returning its original thickness starting immediately after the center line L of the nip formed by the press rolls 1, 2 and extending for a predetermined distance as shown in FIG. 1. Thus the compressive pressure after the center line L of the nip drops very quickly, as can be seen in FIG. 2. The pressure drop is shown by the solid line A. As the mat 5 cannot return to its original thickness immediately after the center line L of the nip, the mat when deviated from the running direction of the web is separated from the web surface as quickly as possible (cf. FIG. 2), thus providing an essential reduction in the rewetting phenomenon.

The mat 5 can be made of e.g. a rubber material, which may be either a natural or synthetic rubber material. Particularly preferable, however, are materials having a high damping factor, because with such materials, the returning of the mat to its original thickness will take a long time. Typical damping factors for such materials are within the range 0.4 to 0.6.

As an example of the stress produced by means of the pair of rolls 6, 7 in the mat 5, the value of approx. 200 N/cm can be given, which will in practice provide a desirable result. It is to be noted here that a reduction as small as 0.1 mm in the thickness of the mat 5 is sufficient for the desired final result.

The present invention is of course by no means limited to the above embodiment, but it can be modified in many different ways within the scope of the claims. Consequently, the tensile stress need not necessarily be produced by means of the aforementioned pair of rolls; other solutions are also possible, etc.

I claim:

1. A method for reducing the rewetting of a web after a press nip, comprising:

passing the web to be dried together with a press felt though the press nip formed by a first pair of press rolls, said press nip having a center line defined between the center of each press roll, separating said web and said felt from each other after the nip, passing a mat of predetermined thickness made of a water-impermeable and resilient material through the press nip, said mat being in contact with the surface of either press roll and one of the surfaces of the web, said mat being compressed during passage through the press nip, separating said mat and said web from each other after the nip, subjecting the mat only to a tensile stress after the press nip for preventing the return of the mat to its original predetermined thickness starting immediately after the center line of the press nip and extending for a predetermined distance.

2. A method as claimed in claim 1, wherein the mat is made of a rubber material.

3. A method as claimed in claim 1, wherein the mat is subjected to a tensile stress by the steps of passing the mat through a second pair of press rolls and rotating the second pair of press rolls faster than the first and second press rolls.

4. A device for reducing the rewetting of a web after the web is passed through a press nip comprising:

a first pair of press rolls forming a press nip, said press nip having a center line defined between the center of each press roll;

a press felt passing through said press nip together with said web, said web and said felt being separated from each other after the press nip;

a mat of predetermined thickness made of a water-impermeable and resilient material passing through said press nip, said mat being in contact with the surface of either press roll and one of the surfaces of the web, said mat being compressed during passage through the press nip and separated from said web after the press nip; and means for producing a tensile stress in the mat only, said tensile stress being produced after the mat passes through said press nip to prevent the mat from returning to its original predetermined thickness starting immediately after the center line of the press nip formed by the first pair of press rolls and extending for a predetermined distance.

5. A device as claimed in claim 4 wherein said means for producing a tensile stress in the mat includes a second pair of press rolls for passing the mat between after the press nip, said second pair of press rolls being adjusted to rotate faster than the first pair of press rolls.

6. A device as claimed in claim 4 wherein said mat is made of a rubber material.

* * * * *